US007351955B2

(12) United States Patent
Kovtoun

(10) Patent No.: US 7,351,955 B2
(45) Date of Patent: Apr. 1, 2008

(54) REDUCTION OF CHEMICAL NOISE IN A MALDI MASS SPECTROMETER BY IN-TRAP PHOTODISSOCIATION OF MATRIX CLUSTER IONS

(75) Inventor: Viatcheslav V. Kovtoun, Santa Clara, CA (US)

(73) Assignee: Thermo Finnigan LLC, San Jose, CA (US)

( * ) Notice: Subject to any disclaimer, the term of this patent is extended or adjusted under 35 U.S.C. 154(b) by 284 days.

(21) Appl. No.: 11/233,825

(22) Filed: Sep. 9, 2005

(65) Prior Publication Data

US 2007/0057173 A1 Mar. 15, 2007

(51) Int. Cl.
*H01J 49/00* (2006.01)

(52) U.S. Cl. ..... 250/281; 250/282; 250/283; 250/284; 250/293; 250/296

(58) Field of Classification Search ..... 250/281–300
See application file for complete search history.

(56) References Cited

U.S. PATENT DOCUMENTS

| | | | | |
|---|---|---|---|---|
| 5,073,713 | A | 12/1991 | Smith et al. | |
| 5,180,914 | A | 1/1993 | Davis et al. | |
| 5,381,006 | A | 1/1995 | Wells et al. | |
| 6,075,244 | A * | 6/2000 | Baba et al. | 250/292 |
| 6,342,393 | B1 | 1/2002 | Hofstadler et al. | |
| 6,610,976 | B2 * | 8/2003 | Chait et al. | 250/281 |
| 6,642,516 | B1 | 11/2003 | Hansen et al. | |
| 6,797,949 | B2 | 9/2004 | Hashimoto et al. | |
| 6,919,562 | B1 | 7/2005 | Whitehouse et al. | |
| 7,119,331 | B2 * | 10/2006 | Chang et al. | 250/292 |
| 7,157,698 | B2 * | 1/2007 | Makarov et al. | 250/281 |
| 2002/0148972 | A1 * | 10/2002 | Krutchinsky et al. | 250/396 R |
| 2004/0119015 | A1 | 6/2004 | Hashimoto et al. | |
| 2004/0217272 | A1 * | 11/2004 | Horning et al. | 250/282 |
| 2005/0151073 | A1 * | 7/2005 | Kato | 250/287 |
| 2005/0178955 | A1 | 8/2005 | Baba et al. | |
| 2005/0258353 | A1 * | 11/2005 | Berkout et al. | 250/281 |
| 2006/0261267 | A1 * | 11/2006 | Sze et al. | 250/288 |

FOREIGN PATENT DOCUMENTS

| | | |
|---|---|---|
| GB | 2390937 A | 1/2004 |

* cited by examiner

*Primary Examiner*—Jack I. Berman
*Assistant Examiner*—Michael J Logie
(74) *Attorney, Agent, or Firm*—Charles B. Katz

(57) ABSTRACT

A MALDI mass spectrometer includes a radiation source, such as a gas or solid state laser, that emits a beam of radiation (typically in the UV or IR wavelengths) directed along the central axis of a linear ion trap in which analyte ions and matrix cluster ions are confined. The radiation beam has a wavelength that is strongly absorbed by the matrix cluster ions. The absorption of radiation by the matrix cluster ions produces dissociation of the matrix cluster ion into fragments having mass-to-charge ratios that lie below a mass-to-charge ratio range of interest. Thus, chemical noise associated with matrix cluster ions is reduced or eliminated.

15 Claims, 6 Drawing Sheets

REDUCTION OF CHEMICAL NOISE IN A MALDI MASS SPECTROMETER BY IN-TRAP PHOTODISSOCIATION OF MATRIX CLUSTER IONS

FIELD OF THE INVENTION

The present invention relates generally to mass spectrometers, and more particularly to an apparatus and method for reducing chemical noise arising from the presence of matrix cluster ions in a MALDI mass spectrometer.

BACKGROUND OF THE INVENTION

One major problem faced by designers and users of mass spectrometers is the presence of chemical noise in the mass spectra. The source and appearance of chemical noise will vary according to the analyte type, ionization method, and operating conditions. For mass spectrometers utilizing matrix-assisted laser desorption/ionization (MALDI), most of the chemical noise is represented by groups of peaks corresponding to matrix cluster ions with compositions described by $(Matrix_x-(y+z-1)H)^+Na_yK_z$(with possible loss of water or ammonia), where x, y, and z may vary from 0 to 8. In addition to these peaks, there is a background noise of complex structure that spans the entire range of mass-to-charge ratios, and which may mask peaks representing the analyte molecule(s) and its fragments. Chemical noise may be particularly problematic in high-throughput operations where careful and frequent cleaning of the MALDI substrate surface (which eliminates some sources of chemical noise) is not practical.

Because the chemical noise imposes a practical lower limit on sensitivity (the minimum analyte quantity that can be reliably detected by a mass spectrometer), there is a strong motivation to develop techniques that eliminate or minimize chemical noise sources. One such technique involves heating the matrix cluster ions to a temperature sufficient to break the relatively weak non-covalent bonds, such as hydrogen bonds or Van der Waals forces, which hold the matrix clusters together. However, applying heat thermally to the matrix cluster ions may have the undesirable effect of promoting decomposition of labile analyte ions. Furthermore, heating the analyte ions increases their kinetic energy and may adversely affect transmission and trapping efficiencies.

SUMMARY

In brief, a mass spectrometer according to an embodiment of the present invention includes a MALDI source, ion transport optics, a linear ion trap, and a laser or other radiation source configured to direct a radiation beam along a longitudinal axis of the ion trap. Ions produced by the MALDI source, which include both analyte ions and matrix cluster ions, are trapped within the linear trap and are cooled by collisions with damping gas molecules such that the ion cloud (the volume occupied by most of the ions) shape approximates a narrow cylinder, having a typical diameter of less than 1 mm. The radiation beam is positioned to overlap with and preferably envelop the ion cloud. The radiation source may take the form of a pulsed gas or solid-state laser that emits UV or IR light at a frequency that is strongly absorbed by the matrix cluster ions but is less efficiently absorbed by the analyte ions. The absorption of radiation by the matrix cluster ion results in the breaking of at least one bond and the consequent dissociation of the matrix cluster ion into two or more low molecular weight components having mass-to-charge ratios that lie below the mass-to-charge ratio range of interest (the range in which the analyte and/or its fragments lie). Thus, chemical noise associated with matrix cluster ions is reduced or eliminated. In certain implementations of the invention, the photodissociation process may be applied after or during isolation of an ion of interest in the ion trap.

In accordance with an alternative embodiment, a supplemental oscillating field may be generated in the ion trap to cause analyte ions to travel outside of the region irradiated by the laser beam while still remaining confined within the trap. The frequency (or range of frequencies) of the supplemental field is selected such that the matrix cluster ions are not excited, or excited to a lesser degree relative to the analyte ions, and so the matrix cluster ions stay within the irradiated. In this manner, the analyte ions receive less radiation than the matrix cluster ions. This embodiment may be particularly useful to avoid undesired fragmentation when the analyte ions are absorptive at the laser beam frequency.

In accordance with another aspect of the invention, a MALDI mass spectrometer is provided having a single radiation source that performs the dual functions of ion production and matrix cluster dissociation. This is accomplished by disposing an optical switching device in the radiation beam so that the beam may be selectively switched between a first beam path terminating at the sample, and a second beam path extending along the centerline of the linear ion trap.

DETAILED DESCRIPTION OF EMBODIMENTS

Figure 1:
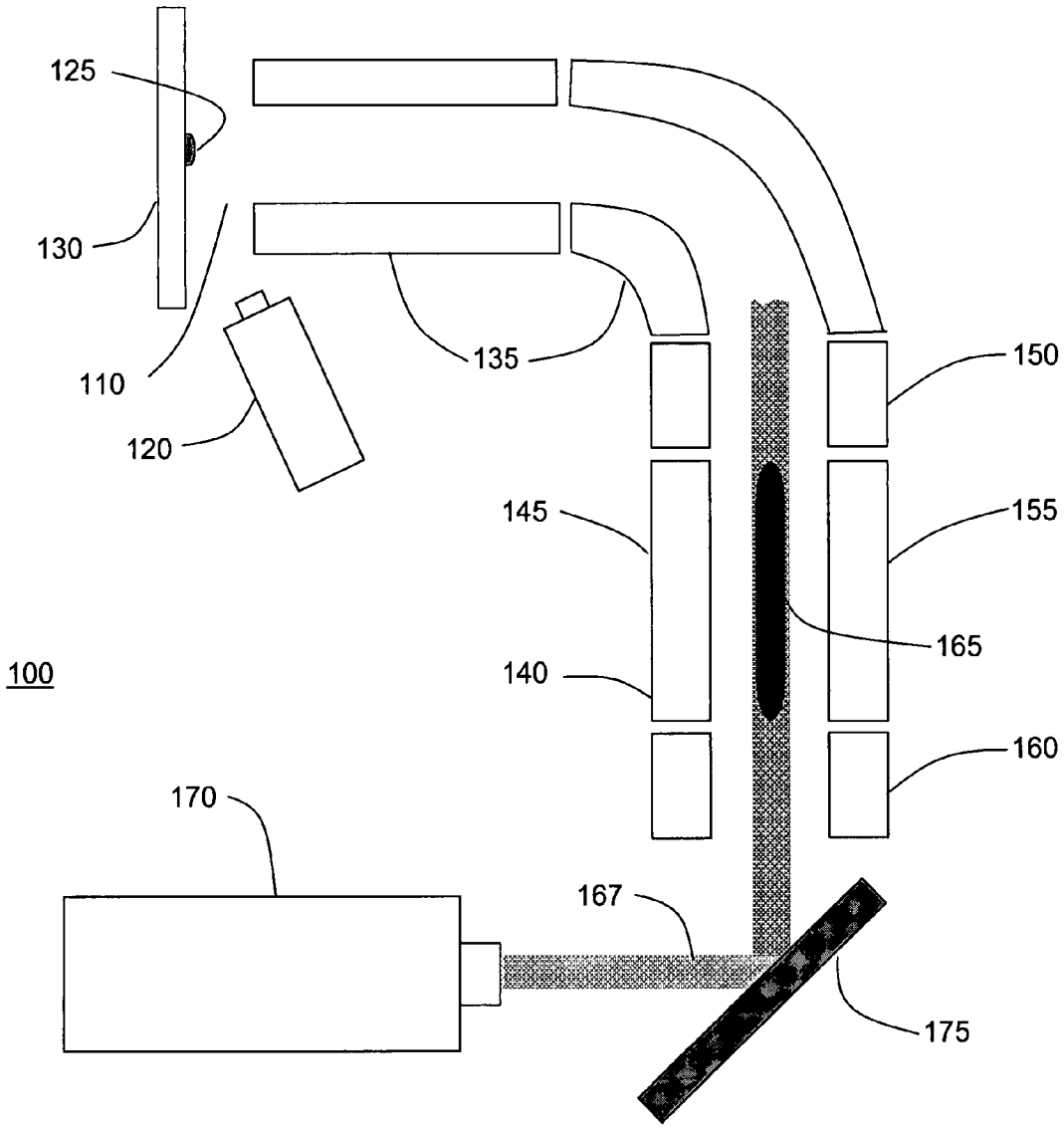
FIG. 1 is a symbolic depiction of a mass spectrometer configured for in-trap photodissociation of matrix cluster ions, in accordance with an embodiment of the present invention.

FIG. 1 is a symbolic depiction of a mass spectrometer system 100 configured in accordance with a first embodiment of the invention. A MALDI source 110 is provided to generate analyte ions from a sample 125. MALDI source 110 includes a laser 120 that emits a pulsed laser beam at a wavelength strongly absorbed by the matrix material. The pulsed beam is directed onto sample 125 deposited on a sample plate 130. Sample plate 130 may be mounted to a positioning mechanism that may be moved within the plane of sample plate 130 to align the laser beam with a selected region of the sample. Sample 125 is typically prepared by mixing a solution of the analyte substance with a matrix substance such as (without limitation) DHB (2,5-dihydrobenzoic acid) or α-CHA (α-cyano-4-hydroxycinnamic acid). The solution is then deposited onto a target area of the sample plate, and the solvent is evaporated, leaving a sample spot of co-crystallized analyte and matrix molecules. Alternatively, a tissue sample may be prepared by applying (e.g., by electrospraying) a matrix solution to a thin layer of tissue affixed to a supporting substrate. The foregoing sample preparation techniques are provided only as illustrative examples, and the present invention should not be construed as being limited to use in connection with any particular sample type or sample preparation method. As is known in the art, irradiation of sample 125 with a laser beam of suitable wavelength and power causes the sublimation of the matrix crystals and expansion of the matrix into the gas phase, which entrains intact analyte molecules into an expanding ion plume. The ion plume is thereafter transported under the influence of electric fields produced in ion optics 135 (which may include one or more ion guides or lenses) to a mass analyzer, which takes the form in this case of a two-dimensional linear trap 140.

The ion plume generated by MALDI source 110 will typically contain matrix cluster ions. The components of the matrix cluster ions are held together by non-covalent or weak covalent bonds. As discussed above in the background section, the matrix cluster ions, if not dissociated or otherwise eliminated prior to mass analysis, may contribute significantly to chemical noise, thereby masking the analyte signal and reducing instrument sensitivity. This problem may be avoided or minimized in accordance with the invention by photodissociation of the matrix cluster ions in the ion trap, in the manner described below.

The analyte ions and matrix cluster ions are gated into ion trap 140 by applying or removing a DC voltage to or from an entrance section of the ion trap or a lens or other electrostatic device. Various automatic gain control (AGC) methods known in the art may be utilized to control and optimize the ion population within the ion trap. Ion trap 140 is preferably implemented as a conventional two-dimensional (also known as linear) ion trap of the type discussed in U.S. Pat. No. 5,420,425 to Bier et al. and incorporated into the Finnigan LTQ mass spectrometer (Thermo Electron, San Jose, Calif.). The trap is constructed from four parallel spaced-apart elongated electrodes 145, each preferably having a hyperbolic surface. Each electrode 145 may be segmented into entrance 150, exit 155 and medial 160 sections, which are electrically isolated from one another so that they may be held at different DC potentials to create a potential well that axially confines ions to the medial portion of the trap interior. Alternatively, axial confinement may be effected by providing opposed end electrodes and applying a supplemental oscillating voltage to the end caps to create an axial pseudopotential. Radial confinement of ions in the trap interior is achieved by applying RF voltages to opposed electrode pairs to generate a substantially quadrupolar electric field within the trap. One or more of electrodes 145 may be adapted with a slot to allow ejection of ions therethrough. Supplemental oscillating voltages may be applied to the electrodes to resonantly excite ions for precursor selection and/or collisionally induced dissociation of ions of interest for $MS^n$ analysis.

The kinetic energy of ions injected into ion trap 140 is preferably reduced by collisional cooling prior to initiating photodissociation of the matrix cluster ions. The interior of trap 140 is preferably filled with an inert damping gas, such as helium, that provides cooling of ions within the trap so that the ions are focused to a narrow cylindrical volume centered about the trap axial centerline. A cooling time of about 1-2 milliseconds (ms) is usually sufficient to achieve the desired degree of kinetic energy damping. Typical damping gas pressures for ion trap operation will be around 1 millitorr. The ion-occupied volume 165 (the smallest volume occupied by about 95 percent of the collisionally cooled ions), also referred to herein as the ion cloud, will depend on trap and ion parameters. Based on computer modeling of ion motion within the Finnigan LTQ trap at typical operating conditions, the diameter of ion cloud 165 is believed to be approximately 1 mm. The ion cloud 165 has an axial dimension that is roughly coextensive with the longitudinal extent of the medial section of the electrodes.

Signal-to-noise ratios and instrument sensitivity may be improved by isolating in trap 140 ions having mass-to-charge ratios within a range of interest, thereby removing components of chemical noise arising from those matrix cluster ions having mass-to-charge ratios lying outside of the range of interest. As is known in the art, isolation may be achieved by application of a notched broadband isolation voltage to the trap electrodes 145. The isolation voltage is composed of a plurality of frequency components that correspond to the secular frequencies of the ions having the undesired mass-to-charge ratios, while being substantially devoid of frequencies that match the secular frequencies of the ions within the range of interest. Thus, the undesired ions become kinetically excited and are removed from the trap via ejection or collision with electrode surfaces, while the ions in the range of interest are not kinetically excited, or are excited to a much lesser degree, and remain confined within the trap.

Following completion of the ion cooling and (optionally) the ion isolation operations, the matrix ion clusters are dissociated by passing a beam of radiation at a wavelength that is strongly absorbed by the matrix cluster ions along the centerline of the trap. The beam 167 may be generated by a laser 170, such as a gas or solid-state laser, that is capable of generating radiation having suitable wavelength and power. One or more beam turning elements, such as mirror 175, may be disposed in the beam path to direct the beam along the trap 140 centerline. The beam 167 is oriented and sized to substantially overlap ion cloud 165 such that a large fraction or all of the ions in ion cloud 165 are positioned within the beam and are exposed to the radiation. In a typical implementation, beam 167 has a diameter of about 1 mm. The absorption of the beam energy by the matrix ion clusters will cause a substantial fraction of the weakly-bonded clusters to dissociate into a plurality of fragments. Generally, a matrix ion cluster composed of a greater number of matrix molecules will exhibit more efficient absorption of photons relative to a matrix ion cluster composed of a lesser number of matrix molecules, so the time required for dissociation to occur will increase as the number of matrix molecules (and mass) decreases. The radiation is preferably delivered as a train of pulses. The number of pulses required to achieve a desired degree of fragmentation may depend on (inter alia) the pulse energy and width, ion cloud and laser beam geometries, cluster bond strength and absorption efficiencies. In tests done using a sample consisting of 1 femtomole of angiotensin in 5 mg/ml α-CHA matrix solution in a modified LTQ ion trap using a Nd:YLF laser having a pulse energy of 150 μJ, a wavelength of 349 nm, a pulse width of 9 ns, and a repetition rate of 1 kHz, it was found that a total of 90 pulses produced an appreciable improvement in signal-to-noise ratios and reduction of chemical noise attributable to matrix cluster ions.

The fragments resulting from photodissociation will have mass-to-charge ratios that are significantly reduced relative to the matrix cluster ions. Certain of these fragments may have mass-to-charge ratios that are below the low-mass cutoff (LMCO) limit and will develop unstable trajectories that will remove them from the trap. Fragments that remain confined within the trap may be removed by a second isolation step, or may alternatively be scanned out of the trap during a mass-selective analysis scan. Since the mass-to-charge ratios of the fragments will typically be substantially below those of the analyte molecules, the presence of the fragments in the trap do not cause noise at the mass-to-charge ratios of interest and hence do not adversely affect instrument sensitivity.

While the irradiation and consequent photodissociation of matrix cluster ions may be performed in other regions of the mass spectrometer system, e.g., within sections of the ion optics or within an associated collision cell (not depicted), in-trap irradiation offers several advantages. Cooling of the ions within trap 140 by collision with damping gas atoms or molecules produces an ion cloud 165 having a narrow diameter that can be closely matched to the radiation beam diameter. In contrast, the ion beam diameter within low-pressure regions (having pressures well below 1 millitorr) of the ion optics will typically be significantly wider than the ion cloud 165 diameter within trap 140. If photodissociation of matrix cluster ions were to be performed within the low-pressure ion optics, the radiation beam would need to be expanded using appropriate optical elements to match its diameter to that of the ion beam; furthermore, the reduced beam fluence associated with the expanded beam size may reduce the efficiency of cluster fragmentation. We note that even if the ion optics (or a region thereof) were to be operated at a pressure similar to that of ion trap 140 (close to 1 millitorr), the residence time of ions within the ion optics is typically inadequate for the delivery of a sufficient number of radiation pulses for dissociation of matrix cluster ions to occur to an appreciable degree. Within the intermediate—pressure regions of the ion optics (having pressures on the order of 10-100 millitorr), the ion beam diameter may be comparable in size to that of ion cloud 165 (facilitating matching to the radiation beam diameter), but the loss of energy through collisions occurs at a significantly elevated rate, thereby requiring a larger radiation energy input to initiate declusterization.

Figure 2:
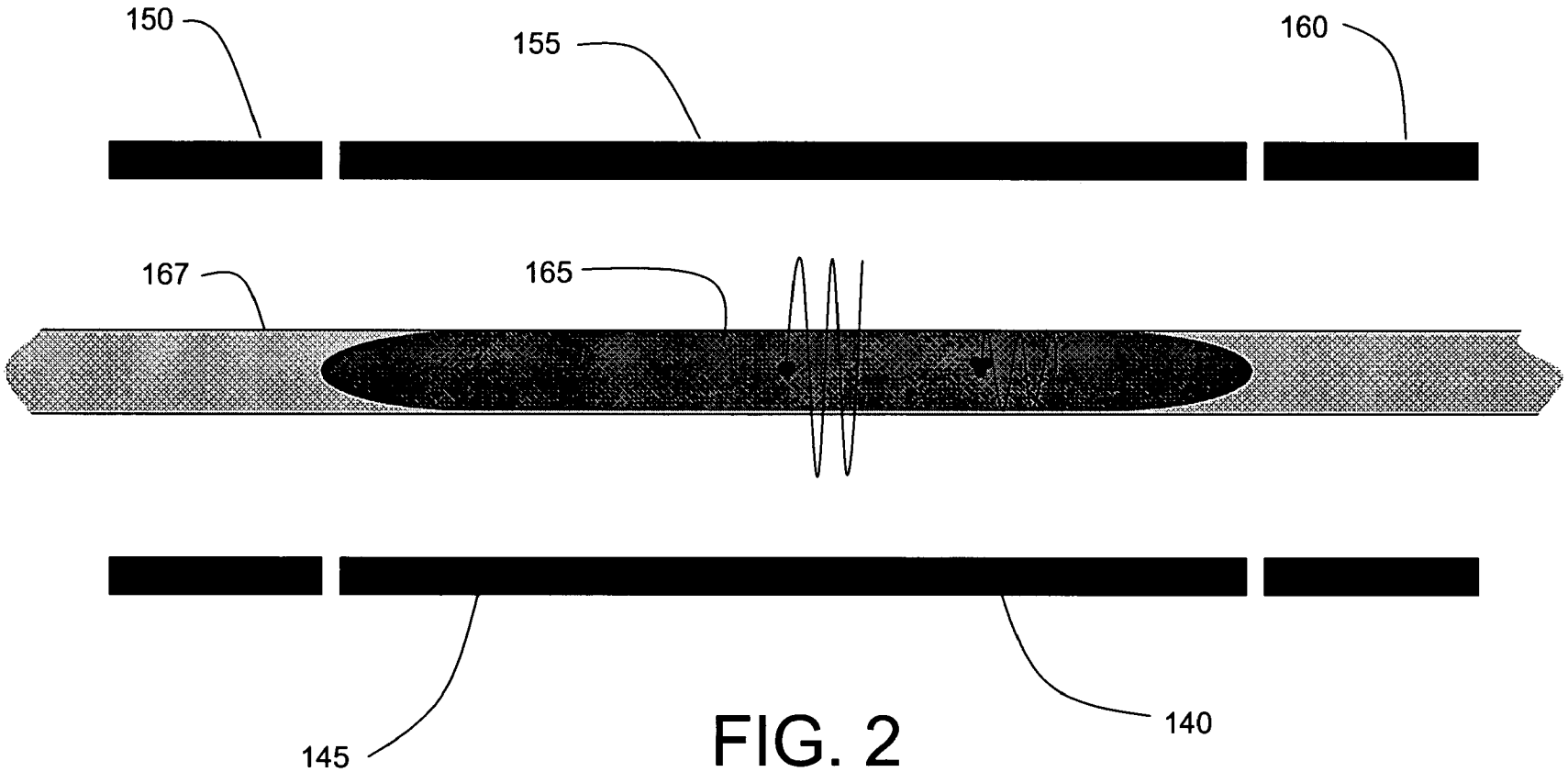
FIG. 2 is a symbolic diagram of the linear trap, depicting the effect of the application of a supplemental excitation field on the motion of analyte and matrix cluster ions in accordance with a variation of the in-trap dissociation technique.

The above-discussed cluster fragmentation technique assumes that the ions of interest are non-absorptive or weakly absorptive at the wavelength of laser 170. If, however, the ions of interest exhibit moderate or high absorption at the laser wavelength, they may undergo photo-induced dissociation as well. This undesirable result may be reduced by employing the technique depicted in FIG. 2. According to this technique, a supplemental oscillating voltage is applied to the ion trap electrodes 145 while ion cloud 165 is irradiated. The supplemental voltage has a frequency that matches a secular frequency of the ions of interest, but not that of the matrix ion clusters. Application of the supplemental voltage causes the ions of interest to become kinetically excited so that they develop a trajectory that extends outside of the region irradiated by laser beam 167. Generally, the amount of kinetic excitation and the degree to which the ions' trajectory extends outside of the irradiated region will increase with increasing supplemental voltage amplitude; however, care must be taken to avoid exciting the ions to the point where they strike trap surfaces or are ejected. Because the kinetically excited ions are only within the irradiated region during a fraction of the total irradiation time, they will absorb less energy relative to the matrix cluster ions and are thus less likely to undergo fragmentation. Once irradiation is completed, the supplemental voltage is turned off and the ions of interest lose kinetic energy and are again collisionally focused to the trap centerline.

Figure 3A:
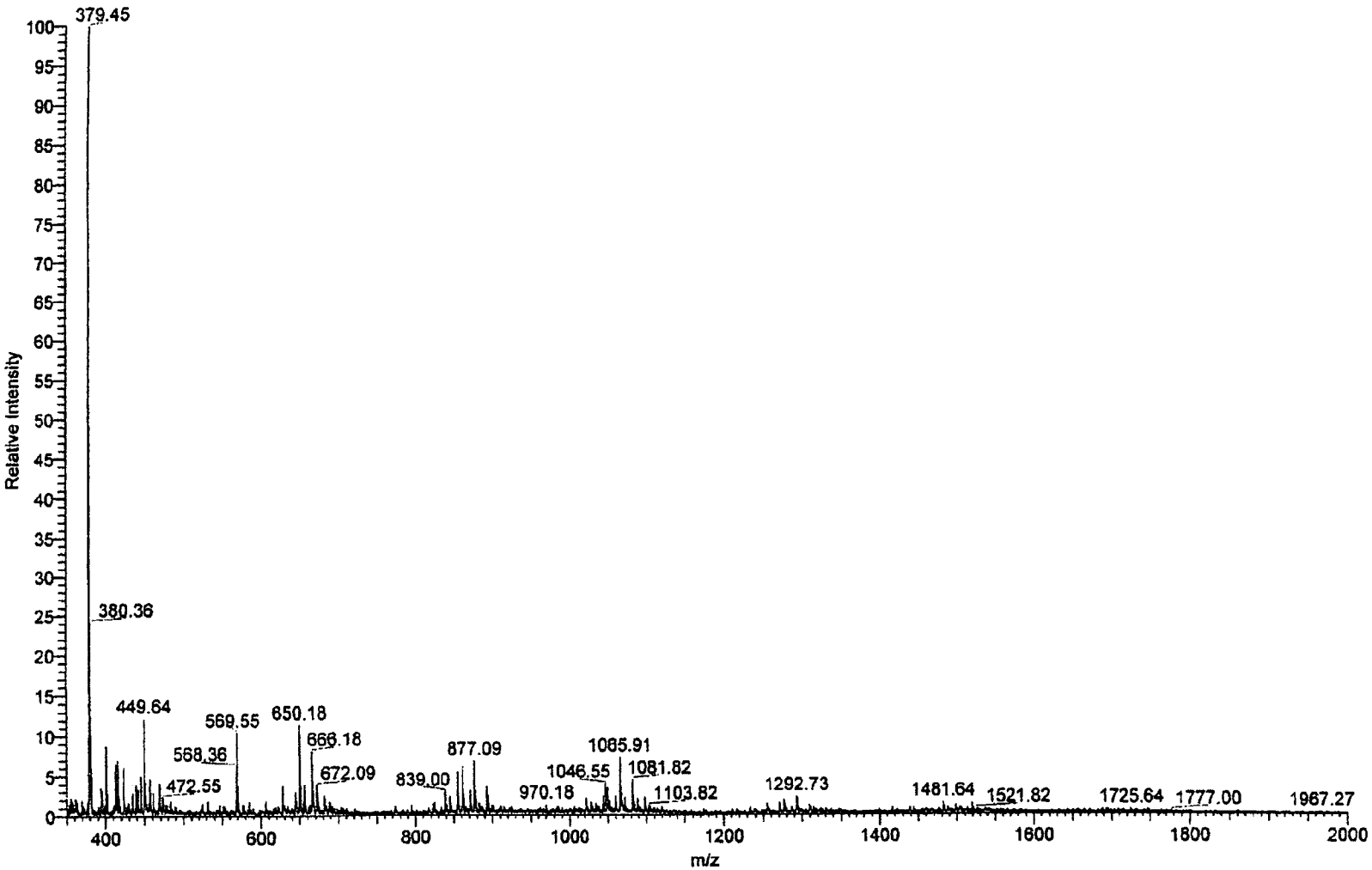
FIGS. 3(*a*) and 3(*b*) depict mass spectra of melittin from a MALDI mass spectrometer respectively obtained without and with photodissociation of matrix cluster ions.
Figure 3B:
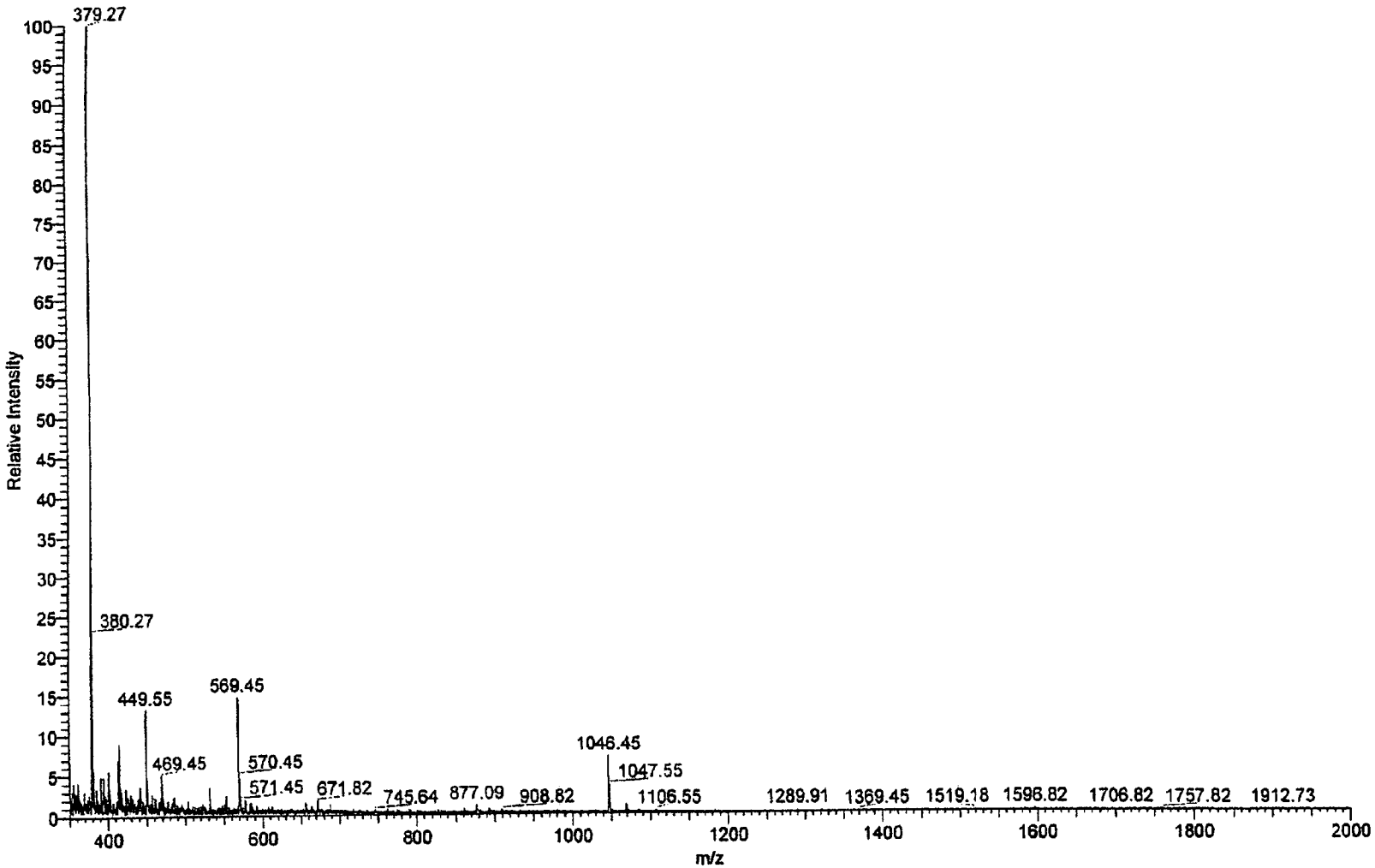

The benefit realized by employing the cluster dissociation technique of the invention is illustrated by FIGS. 3(*a*) and 3(*b*), which respectively depict mass spectra of an angiotensin analyte obtained in the absence of and with photodissociation of matrix cluster ions. Comparison of corresponding regions of the mass spectra (for example, near m/z=1046) reveals that photodissociation produces a significant decrease in the signals associated with the presence of multiple matrix cluster groups.

Figure 4A:
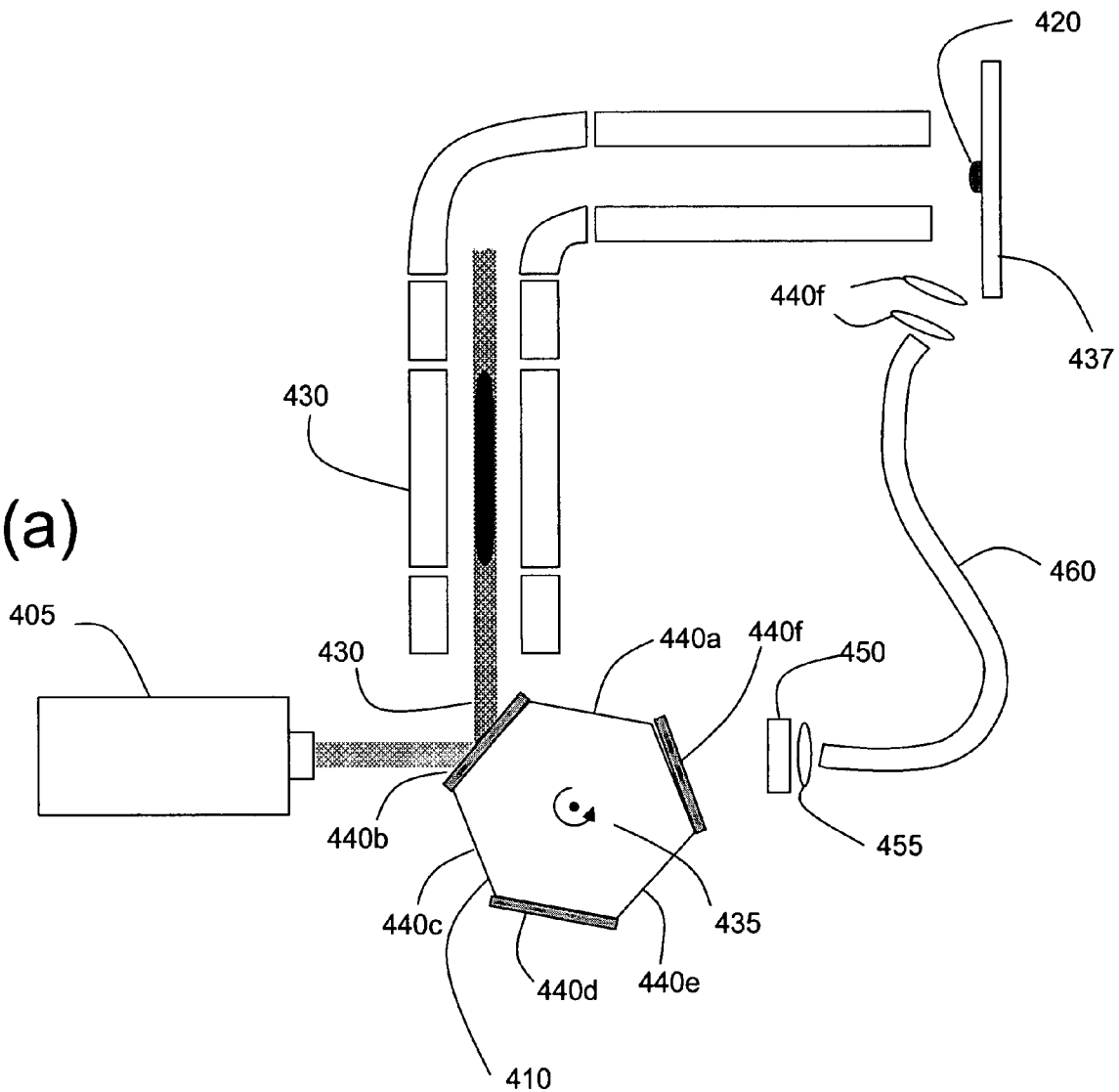
FIGS. 4(*a*) and 4(*b*) depict a second embodiment of a mass spectrometer configured for in-trap dissociation of matrix cluster ions, wherein a single laser source is employed for both ion production and cluster dissociation.
Figure 4B:
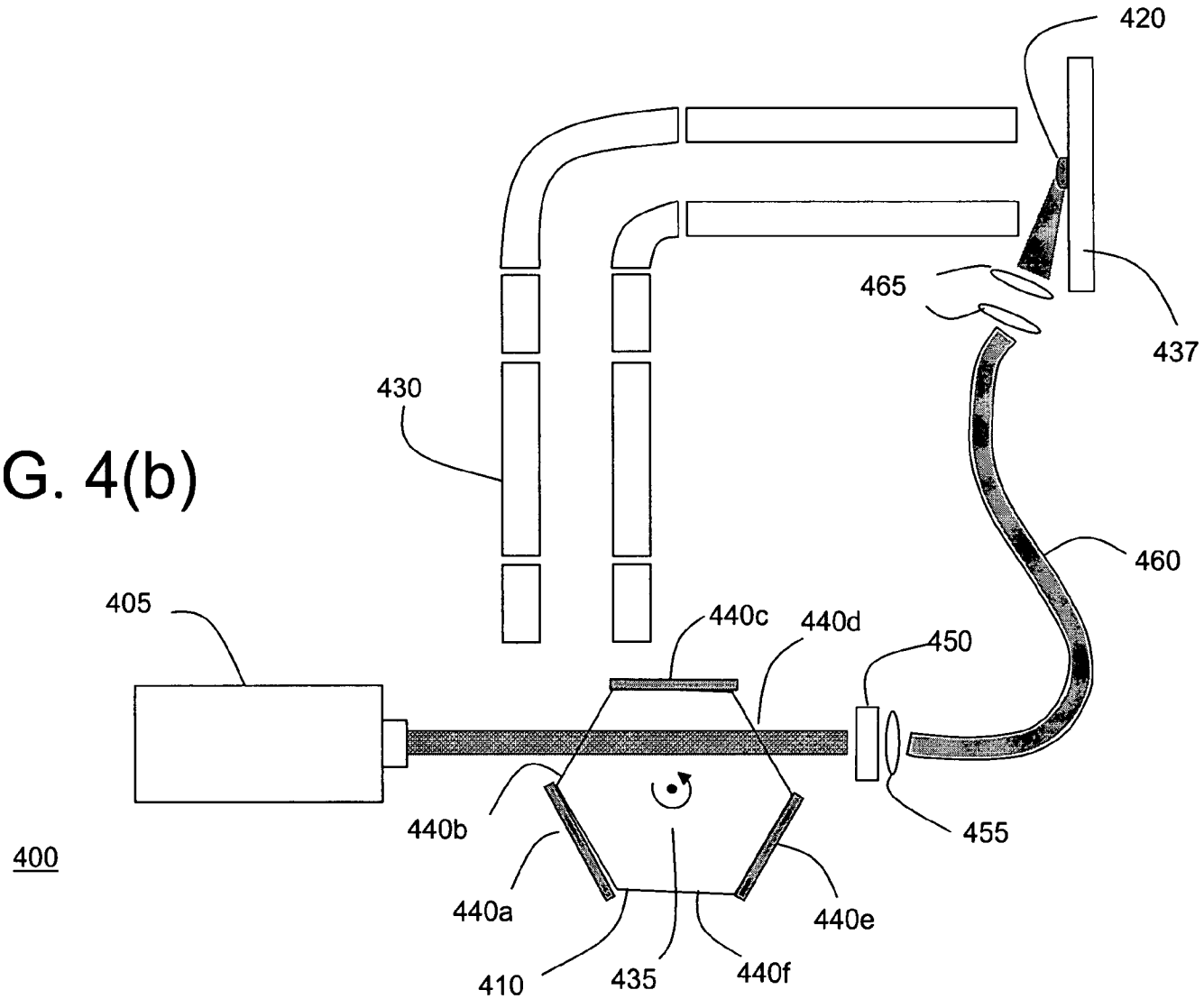

FIGS. 4(*a*) and 4(*b*) depict an alternative embodiment of a mass spectrometer 400, which differs from the FIG. 1 embodiment by its utilization of a single laser 405 to perform the functions of sample desorption/ionization and photodissociation of matrix cluster ions. Laser 405 may take the form of a gas or solid-state (e.g., Nd:YAG or Nd:YLF) laser that emits radiation of a suitable wavelength. Utilization of a single shared laser 405 in place of two separate lasers may offer substantially benefits in terms of reducing the instrument cost and size. The single laser architecture is enabled by use of a beam switching element 410, which controllably switches the beam generated by the laser between a MALDI beam path 415 that terminates at sample 420, and a photodissociation beam path 425 that extends through ion trap 430. Beam switching element 410 is initially operated in the MALDI beam path setting to irradiate the sample to produce a plume of ions. After the sample ions have been generated and transported to ion trap 430, beam switching element 415 is operated in the photodissociation beam path setting to irradiate the ions in the trap and dissociate the matrix cluster ions. Once the matrix cluster ion photodissociation operation is complete, beam switching element 415 is subsequently returned to the MALDI beam path setting to produce additional ion plumes for analysis. The number of pulses that laser 405 delivers for the ion production and photodissociation operations may be adjusted according to operational parameters and performance requirements. The optimal timing of the ion production and cluster photodissociation cycles will depend on various factors, including sample and instrument parameters. In a typical implementation, the time between successive ion production and cluster dissociation operations may be about 20 milliseconds.

In the implementation shown in FIGS. 4(*a*) and 4(*b*), beam switching element 420 takes the form of a rotatable mirror structure. Beam switching element 410 includes a substantially transparent body 435 having a plurality of facets, the facets being alternately transmissive (labeled as 440*a, c, e*) and reflective (labeled as 440*b, d, f*) at the laser wavelength. Facets 440*b, d, f* may be rendered reflective by application of a suitable reflective coating. Beam switching element 410 may be rotated between or among a set of discrete rotational orientations by a stepper motor or other electromechanical device (not depicted). The set of rotational orientations will include at least a first orientation in which the laser beam is reflected from one of the reflective facets and directed on dissociation beam path 415 extending longitudinally through ion trap 430, and a second orientation wherein the beam enters and exits body via transmissive facets, and is subsequently directed on MALDI beam path 425 to sample 425 located on plate 437. FIG. 4(*a*) depicts the beam switching element in the first orientation, wherein the laser beam 415 is reflected by reflective facet 440*b* and directed along the ion trap 430 centerline for matrix cluster ion dissociation. In FIG. 4(*b*), the beam switching element 410 is in the second position, allowing the laser beam 425 to enter body 435 through transparent facet 440*a* and exit through transparent facet 440*c*. The beam subsequently passes through a beam expander 450 and lens 455, which couple the beam into an entrance end of optical fiber 460. The beam travels through optical fiber 460 and emerges from an exit end of the fiber. The beam is thereafter focused by lenses 465 onto sample 425 for sample irradiation and consequent ion production. The typical beam diameter at the sample is approximately 100-200 μm. The optical configuration described herein for delivery of the beam to the ion trap and sample locations from the beam switching element is intended only as an illustrative example, and should not be construed as limiting the invention to use with an optical fiber or any other specific implementation of the optical pathways.

It should be appreciated that the rotatable mirror structure described above represents but one example of a beam switching element. As used herein, the term "beam switching element" is intended to include any structure or combination of structures that enable the beam to be controllably switched between at least two paths. One or both of the paths may include a light-guiding structure such as an optical fiber or planar waveguide. In other implementations, the beam switching element may take the form of (without limitation) a different configuration of electromechanically actuated device (such as a rotating or sliding mirror or prism), an electro-optical or acousto-optical switch, or an all-optical switch.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated.

What is claimed is:

1. A mass spectrometer, comprising:

a matrix-assisted laser desorption and ionization (MALDI) source for producing ions by irradiating a sample;

a two-dimensional ion trap having an interior into which at least a portion of the ions are admitted, the ions including analyte ions and matrix cluster ions, the ions occupying an ion cloud; and a radiation source for generating a beam of radiation that overlaps with the ion cloud, the radiation having a frequency that is strongly absorbed by the matrix cluster ions such that at least a portion of the matrix cluster ions undergo dissociation;

wherein the linear ion trap is further configured to generate a supplemental oscillating field that causes the analyte ions, but not the matrix cluster ions, to travel outside of the radiation beam.

2. The mass spectrometer of claim 1, wherein the interior of the ion trap is filled with a damping gas to focus the ions to the ion trap centerline.

3. The mass spectrometer of claim 1, wherein the radiation source is a laser that emits pulses of infrared or ultraviolet light.

4. The mass spectrometer of claim 1, wherein the beam of radiation has a diameter that is at least as great as a diameter of the ion cloud.

5. The mass spectrometer of claim 1, wherein the ion cloud is positioned substantially within the radiation beam.

6. The mass spectrometer of claim 1, wherein the ion trap is configured to generate an oscillating electric field to selectively remove ions having mass-to-charge ratios lying outside of a range of interest by resonant excitation.

7. A mass spectrometer, comprising:

a matrix-assisted laser desorption and ionization (MALDI) source for producing ions by irradiating a sample;

a two-dimensional ion trap having an interior into which at least a portion of the ions are admitted, the ions including analyte ions and matrix cluster ions, the ions occupying an ion cloud;

a radiation source for generating a beam of radiation that overlaps with the ion cloud, the radiation having a frequency that is strongly absorbed by the matrix cluster ions such that at least a portion of the matrix cluster ions undergo dissociation; and a beam switching element positioned in the radiation beam configured to controllably switch the radiation beam between first and second beam paths, the first beam path terminating at the sample for producing ions therefrom, and the second beam path overlapping the ion cloud.

8. The mass spectrometer of claim 7, wherein the beam switching element includes a rotatable mirror having alternating reflective and non-reflective facets.

9. The mass spectrometer of claim 7, further including a beam expander positioned in the first beam path.

10. A method for reducing chemical noise in a MALDI mass spectrometer, comprising the steps of:

producing ions by irradiating a sample containing an analyte and a matrix;

admitting the ions into the interior of a two-dimensional ion trap, the ions occupying an ion cloud and including analyte ions and matrix cluster ions;

irradiating the matrix cluster ions with a beam of radiation directed along the interior of the ion trap to cause at least a portion of the matrix cluster ions to dissociate into fragments; and generating a supplemental electric field within the ion trap to cause the analyte ions, but not the matrix cluster ions, to travel outside of the radiation beam.

11. The method of claim 10, further comprising a step of collisionally cooling the ions to focus the ions to the trap centerline.

12. The method of claim 10, wherein the ion cloud is positioned substantially within the radiation beam.

13. The method of claim 10, further comprising a step of resonantly exciting ions having mass-to-charge ratios outside of a range of interest to remove them from the ion trap.

14. A method of reducing chemical noise in a MALDI mass spectrometer, comprising the steps of:

producing ions by irradiating a sample containing an analyte and a matrix;

admitting the ions into the interior of a two-dimensional ion trap, the ions occupying an ion cloud and including analyte ions and matrix cluster ions;

irradiating the matrix cluster ions with a beam of radiation directed along the interior of the ion trap to cause at least a portion of the matrix cluster ions to dissociate into fragments; and controllably switching the radiation beam between a first beam path tenninating at the sample, and a second beam path extending along the interior of the ion trap.

15. A mass spectrometer, comprising: a matrix-assisted laser desorption and ionization (MALDI) source for producing ions by irradiating a sample; a two-dimensional ion trap having an interior into which at least a portion of the ions are admitted, the ions including analyte ions and matrix cluster ions, the ions occupying an ion cloud; and a radiation source for generating a beam of radiation that overlaps with the ion cloud, the radiation having a frequency that is strongly absorbed by the matrix cluster ions and not absorbed or weakly absorbed by the analyte ions, such that at least a portion of the matrix cluster ions undergo dissociation without substantial dissociation of the analyte ions wherein the efficiency of trapping of ions within the interior of the ion trap is not adversely affected by absorption of the radiation beam by the analyte ions.

* * * * *